United States Patent [19]

Clark

[11] Patent Number: 4,458,756

[45] Date of Patent: Jul. 10, 1984

[54] HEAVY OIL RECOVERY FROM DEEP FORMATIONS

[75] Inventor: Silas Clark, Houston, Tex.

[73] Assignee: Hemisphere Licensing Corporation, The Woodlands, Tex.

[21] Appl. No.: 291,988

[22] Filed: Aug. 11, 1981

[51] Int. Cl.[3] ..... E21B 43/243; E21B 43/24

[52] U.S. Cl. ..... 166/260; 166/262; 166/272; 166/261

[58] Field of Search ..... 166/262, 256–261, 166/272, 303, 57

[56] References Cited

U.S. PATENT DOCUMENTS

| | | | |
|---|---|---|---|
| 2,913,050 | 11/1959 | Crawford | 166/262 X |
| 2,958,380 | 11/1960 | Schild | 166/256 |
| 3,076,505 | 2/1963 | Pryor | 166/262 |
| 3,159,216 | 12/1964 | Reed et al. | 166/259 |
| 3,219,108 | 11/1965 | Monroe | 166/260 |
| 3,409,083 | 11/1968 | Prats | 166/256 |
| 3,457,995 | 7/1969 | Cornelius et al. | 166/260 |
| 3,482,630 | 12/1969 | Earlougher, Jr. | 166/260 |
| 3,805,885 | 4/1974 | Van Huisen | 166/272 X |
| 3,809,159 | 5/1974 | Young et al. | 166/258 |
| 4,272,383 | 6/1981 | McGrew | 166/302 X |
| 4,330,038 | 5/1982 | Soukup et al. | 166/272 X |

*Primary Examiner*—Stephen J. Novosad

*Attorney, Agent, or Firm*—Jerry Cohen; William Noonan; M. Lawrence Oliverio

[57] ABSTRACT

Method of heavy oil recovery from deep formations using in-situ wet oxidation steam generation, and a generator for such purpose, comprising a feed for a coal/-water slurry and a feed of oxidative gas from ground level to the formation, forming a cavity in the formation where the slurry and gas meet for "wet oxidation" under the inherent pressures and temperature of the deep cavity, augmented by pressurizing the feeds and, if necessary by use of a primary ignitor, to generate carbon dioxide and steam which forces the heavy oil through one or more producing regions located in the formation in the neighborhood of the cavity. Packing may be set in place above the formation to limit escape of productive gas products of the wet oxidation.

5 Claims, 1 Drawing Figure

HEAVY OIL RECOVERY FROM DEEP FORMATIONS

BACKGROUND OF THE INVENTION

Very heavy oils are usually produced with the aid of one of several thermally enhanced oil recovery techniques: steam injection, fire flooding and electric resistance or microwave heating. Presently, steam injection is confined to shallow reservoirs, i.e., less than 1500 ft. The energy losses associated with delivering steam to the face of a deeper oil sand can be overcome by the use of insulated pipe or by the generation of steam down-hole. However, insulated pipe is expensive and down-hole steam generators are expensive also. Fire flood and electric heating are also limited in their practical utility for deep formations.

Down-hole steam generators and other deep formation drive gas sources were thoroughly explored in the DEEP STEAM R&D project of the U.S. Department of Energy and in the Society of Petroleum Engineers/-Department of Energy Second Joint Symposium on Enhanced Oil Recovery (Apr. 5–8, 1981—Tulsa, Okla.) The studies show a long term continuing unmet need for economically practical down-hole gas generator to drive heavy oil in deep formations.

It is an object of the present invention to meet such need.

SUMMARY OF THE INVENTION

An in situ wet oxidation steam generator is used to meet the foregoing object; it can be implemented in the following manner:

1. Drill through the oil bearing formation into a lower zone where strong, tight rock exist;
2. Set casing to the bottom of the hole and cement in place. Drill through the cement plug at the bottom of the casing and beyond (e.g., 100 feet beyond).
3. Create a cavity in that rock zone below the end of the casing. Explosives, acids, reamers or hydraulic jets might be used for excavation of the rock. The final cavity might be 90′ long (i.e., height dimension) and 10′ in diameter, typically.
4. The casing is then perforated in the standard manner at the oil zone.
5. Two tubes from the surface are inserted into the bottom of the excavated cavity. One of these tubes is to carry a coal and water slurry. The other is to carry air, $O_2$ or a mixture of air and $O_2$.
6. Packing is then set in place above the oil bearing zone so that combustion products and steam cannot escape and must flow into the oil bearing zone.

Wet oxidation is well reported in the literature and can occur between temperatures of 300° F. and 700° F. and between pressures of 300 psi and 3000 psi. Wet oxidation of coal can occur at these temperatures because of several phenomena. First, there is an inverse logarithmic relationship between oxygen partial pressure and ignition temperature. If the oxygen pressure on a coal particle goes up, the ignition temperature comes down. Second, the presence of water lowers ignition temperature. Water is catalytic in the oxidation of coal. Third, some of the components in coal ash, notably sodium and potassium salts, are catalytic in combustion reactions. This combination allows the oxidation of coal at temperatures far below normal coal combustion temperatures.

Oil deposits that are candidates for steam treatment with a down-hole steam generator are usually more than 2000 feet down. Lithostatic pressure increases at the rate of 1 psi/ft. of depth. Hydrostatic pressure increases at the rate of 0.5 psi/ft. of depth. Therefore, a cavity at 2000 ft. down could easily contain a wet oxidation reaction at pressures of 1000 psi to 2000 psi. Oxidation of the fuel is carried out in the liquid phase and under pressure. Therefore, the off gas from the cavity area will be water vapor mixed with combustion gases.

Ash from the burned coal will naturally accumulate in the cavity. Therefore, periodic pumping of the cavity will be necessary to remove the wet sludge formed by coal ash and water.

Primary ignition of the wet oxidation steam generator can be accomplished by pumping in a fuel that is hypergolic when mixed with compressed air. Primary ignition temperature of the fuel slurry may also be achieved by sparging high pressure steam into the wet oxidation cavity before the injection of air or oxygen begins. The minimum temperature and pressure necessary for rapid wet oxidation of coke and lignite fuels are:

| Fuel | Temperature | Pressure |
|---|---|---|
| Coke | 600° F. | 1800 psi |
| Lignite | 500° F. | 800 psi |

These and other objects, features and advantages of the invention will be apparent from the following detailed description of preferred embodiments with reference therein to the accompanying drawing in which:

DETAILED DESCRIPTION OF PREFERRED EMBODIMENTS

Figure 1:
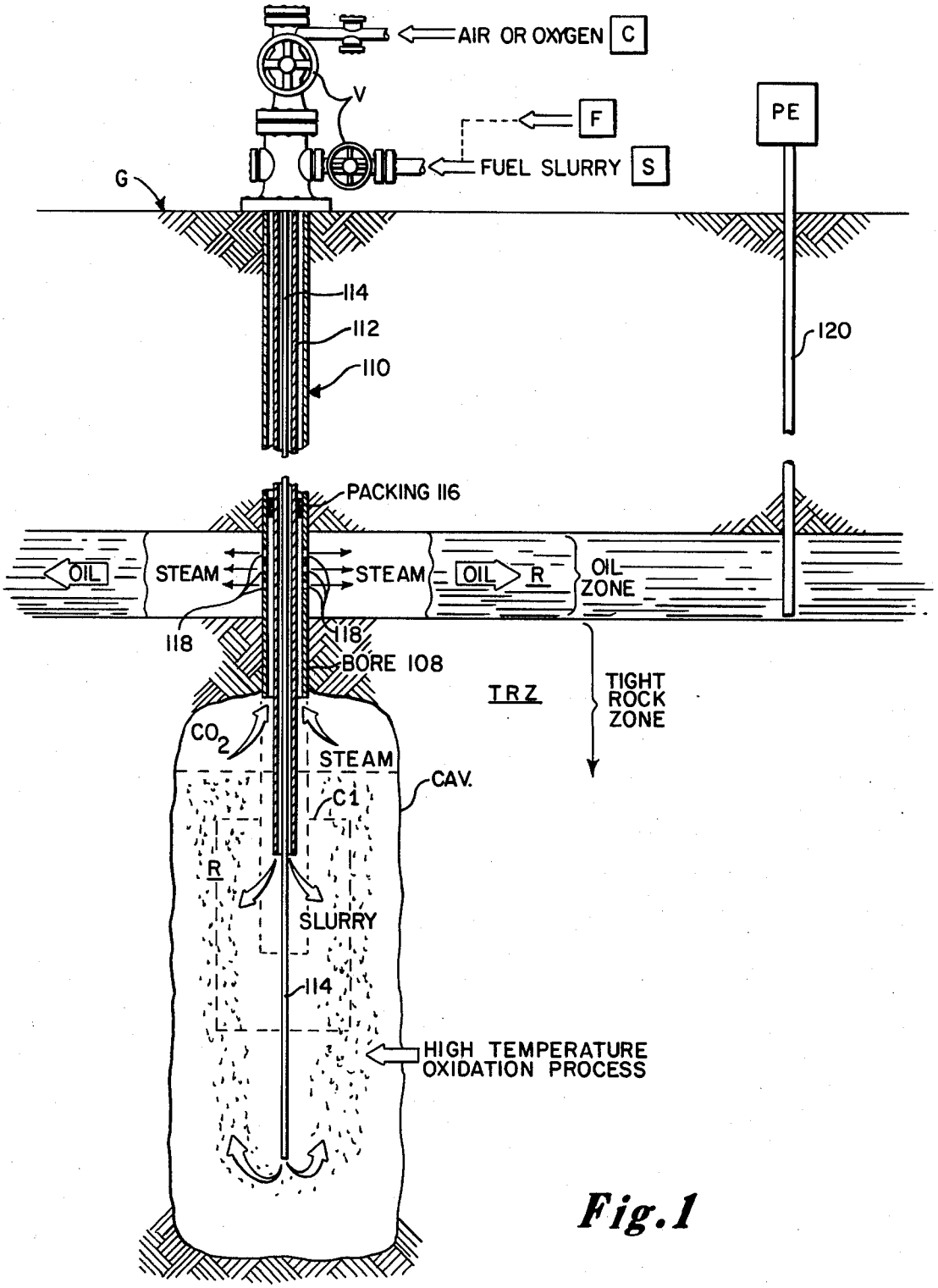
FIG. 1 is a ground cross-section view with breaks for great depth interval illustrating practice of a preferred embodiment of the process of the invention and implementing apparatus.

FIG. 1 shows an earth cross section wherein a heavy reservoir R (oil trapped in rock formation) lies some 2000–3000 feet below ground level G. In accordance with a preferred embodiment of the invention, a bore 108 can be hydraulically or mechanically formed (to a diameter of eight inches) and filled with a casing 110 reaching below the region R into a lower tight rock zone TRZ typically encountered with heavy oil deposits. Explosives can be lowered through the casing into zone TRZ and detonated to form a rubble cavity C1. The rubble can be vacuumed up through the casing and the process repeated to form an ultimate cavity CAV some 200 feet below reservoir R, typically in the form of a vertical cylinder of ten feet diameter and ninety feet in length. Intermediate cavity and rubble removal steps can be inserted to form CAV through 3 or 4 of such cycles instead of a single repeat. Concentric feed tubes 112 and 114 can be passed through the casing and a packing 116 can be implaced around the feed tubes. Perforations 118 are provided in the casing.

The inner feed tube 114 is connected to an air compressor C at ground level (or to other source of oxidative gas). The feed tube 112 is alternatively connectable to a hypergolic primary ignition fuel source F and a main wet fuel slurry source S comprising conventional coal slurry formation means.

Through initial primary oxidation of hypergolic fuel, followed by continuing wet oxidation of the coal slurry, a driving gas charge of carbon dioxide and steam is established in the upper half of CAV. The gases expand and back up through the casing 110 around the feed tubes until stopped by packing 116 and expand out through perforations 118 to provide a driving pressure to the oil reservoir.

The pressure and temperature of the slurry must be maintained to avoid premature steam formation in tube 114 while establishing oxidation of the fuel in CAV.

Some non-limiting examples of the preferred embodiments of how the invention can be practiced are now set forth:

EXAMPLE 1

| | | |
|---|---|---|
| Depth | 3000' | |
| Press. | 1500 psi | |
| Temp. | 545° F. | |
| Fuel | Lignite | |
| Oxidant | air | |
| Off gas | $CO_2$ | 5.9% |
| | $N_2$ | 27% |
| | $H_2O$ | 67% |

Typical flow rates would be 1500 pound/hour injection of lignite as with 12,000 pound/hour of water and 120,000 cubic feet per hour (STP) of air compressed to 1500 psi to produce wet oxidation giving off 12 million BTU/hour.

EXAMPLE 2

| | | |
|---|---|---|
| Depth | 3000 ft. | |
| Press | 1790 psi | |
| Temp. | 600° F. | |
| Fuel | Coke | |
| Oxidant | $O_2$ (Pure) | |
| Off Gas | $CO_2$ | 10.5% |
| | $H_2O$ | 89.5% |
| | | 100% |

The flow rates would be substantially as in Example 1.

In Example 2, the pressure is 1790 psi. The hydrostatic pressure in this case is only 1500 psi. Therefore, the fuel slurry pump at the surface must make up the difference of 290 psi.

EXAMPLE 3

| | | |
|---|---|---|
| Depth | 2000' | |
| Press. | 1000 psi | |
| Temp. | 500° F. | |
| Fuel | Lignite | |
| Oxidant | Air | |
| Off Gas | $CO_2$ | 5.9% |
| | $N_2$ | 27% |
| | $H_2O$ | 67% |

Removing ash sludge from the CAV is needed from time to time. The down-hole wet oxidation boiler could be operated until the ash content obstructs operation. Then water might be pumped in either the fuel tube or the air tube and the ash slurry pumped out the other. This would flush the cavity of ash particles.

Producing wells one of which is indicated at 120 with related pumping equipment PE can be dispersed peripherally around the reservoir locus at effective distances, e.g., 300 feet from casing 110. The pressure of gasses produced by wet oxidation and transmittal of their heat to the trapped oil in the reservoir enables the oil to be driven to the producing well(s) 20 and recovered.

Wet oxidation, per se, is well known in treatment of aqueous wastes and sludges and is described in:

(1) Knopp et al, Chem. Eng. Progress—August, 1979, p.46 et seq.

(2) Othmer, P., Mech'l Eng.—December 1979.

(3) Farouk, A. et al, JPT—October 1979.

(4) Teletzke et al, J. Water Poll. Ctrl—39:994 (1967).

Advantages of steam, with a partial pressure of combustion gas therein) in deep heavy oil formations are shown in, e.g., (5) Meyer et al, paper given at the June 1979 (Edmonton, Alberta, Canada) Firste International Conference sponsored by the United Nations Institute for Training and Research (UNITAR-I)

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is claimed is:

1. Method of deep layer heavy oil gas drive extraction from a deep heavy oil formation with in-situ gas pressure generation comprising (a) forming a subterranean cavity within a rock encased zone which is at least as deep underground as said deep heavy oil zone at a depth having a lithostatic pressure supportive of wet oxidation;

(b) establishing two flow channels from ground level to the cavity, one for oxidative gas and one for a coal and water slurry;

(c) generating and feeding said slurry and gas through the channels at pressure and temperature such that the slurry and gas establish a continual wet oxidation on meeting in the cavity to generate a steam/-carbon dioxide mixture for oil drive utilizing the high hydrostatic and lithostatic pressure in a deep formation to effect in-situ oxidation at conditions of 300-3000 psi and 300° F.-700° F.

(d) establishing a production well in the heavy oil formation so that the wet combustion gases effectively drive heavy oil in the formation toward the production well, (e) raising oil to ground via the production well, and (f) removing wet sludge by-product from the cavity to prevent clogging.

2. The method of claim 1 and further comprising the step of (f) applying a pumping action to the cavity to remove by product sludge therefrom.

3. The method of claim 1 wherein a supplemental step is utilized for starting wet oxidation.

4. The method of claim 3 wherein starter fuel is fed to the cavity for primary ignition.

5. The method of claim 3 wherein steam is injected into the cavity to raise its temperature to a level supporting wet oxidation.

* * * * *